US007441769B2

(12) United States Patent
Miki

(10) Patent No.: US 7,441,769 B2
(45) Date of Patent: Oct. 28, 2008

(54) PAPER FEED TRAY, PAPER FEEDING APPARATUS, AND IMAGE FORMING APPARATUS USING MOVABLE MEMBERS TO MOVE ALIGNING UNITS AND LOCK IN PLACE

(75) Inventor: Katsuhiko Miki, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 149 days.

(21) Appl. No.: 11/270,496

(22) Filed: Nov. 10, 2005

(65) Prior Publication Data

US 2006/0180981 A1 Aug. 17, 2006

(30) Foreign Application Priority Data

Nov. 15, 2004 (JP) ..... 2004-331145

(51) Int. Cl.
*B65H 1/00* (2006.01)

(52) U.S. Cl. ..... 271/171; 399/393

(58) Field of Classification Search ..... 271/171; 399/393

See application file for complete search history.

(56) References Cited

U.S. PATENT DOCUMENTS

| | | | | |
|---|---|---|---|---|
| 5,172,903 | A * | 12/1992 | Haneda et al. | 271/171 |
| 5,758,250 | A | 5/1998 | Miki | |
| 5,823,525 | A | 10/1998 | Miki | |
| 5,848,787 | A | 12/1998 | Miki | |
| 5,934,667 | A | 8/1999 | Miki | |
| 6,014,229 | A * | 1/2000 | Yun | 358/449 |
| 6,523,822 | B1 * | 2/2003 | Galtier et al. | 271/171 |
| 6,585,253 | B1 | 7/2003 | Miki | |
| 6,601,843 | B2 | 8/2003 | Miki | |
| 6,631,899 | B2 | 10/2003 | Miki | |
| 2002/0020959 | A1 | 2/2002 | Matsuda et al. | |
| 2004/0046310 | A1 | 3/2004 | Miki | |
| 2005/0069360 | A1 | 3/2005 | Miki | |

FOREIGN PATENT DOCUMENTS

| | | |
|---|---|---|
| JP | 9-325545 | 12/1997 |
| JP | 09325545 A * | 12/1997 |
| JP | 11-165881 | 6/1999 |
| JP | 2002-187626 | 7/2002 |

* cited by examiner

*Primary Examiner*—Patrick Mackey
*Assistant Examiner*—Gerald W McClain
(74) *Attorney, Agent, or Firm*—Oblon, Spivak, McClelland, Maier & Neustadt, P.C.

(57) ABSTRACT

A detector detects a size of a recording medium stored in a tray of a device. The tray includes a first regulating member that can slide in a width direction of the recording medium, and a second regulating member that can slide in a feed direction of the recording medium. A first movable member engages with the first regulating member, and a second movable member, overlapped by the first movable member, engages with the second regulating member. Both the first and second movable members rotate around a common pivot and include convex members on peripheral edges thereof. Switches are selectively pressed by the convex members when the tray is attached to the device.

5 Claims, 15 Drawing Sheets

FIG.12

| | | | | END FENCE OUTPUT | | | | | SIDE FENCE OUTPUT | | | | | COMBINED OUTPUT | | | | |
|---|---|---|---|---|---|---|---|---|---|---|---|---|---|---|---|---|---|---|
| No. | PAPER TYPE | END FENCE POSITION | SIDE FENCE POSITION | A | B | C | D | E | A | B | C | D | E | A | B | C | D | E |
| 1 | 13″x18″ | 18″ | 13″ | 1 | 1 | 1 | 1 | 0 | 0 | 0 | 0 | 0 | 1 | 1 | 1 | 1 | 1 | 1 |
| 2 | 12″x18″ | 18″ | 12″ | 1 | 1 | 1 | 1 | 0 | 1 | 0 | 0 | 0 | 1 | 1 | 1 | 1 | 1 | 1 |
| 3 | DLT(11″x17″) | 17″ | 11″ | 1 | 1 | 1 | 0 | 0 | 0 | 1 | 1 | 0 | 0 | 1 | 1 | 1 | 0 | 0 |
| 4 | LG(8.5″x14″) | 14″ | 8.5″ | 0 | 0 | 1 | 1 | 0 | 1 | 0 | 0 | 1 | 0 | 1 | 0 | 1 | 1 | 0 |
| 5 | Folio(8.25″x13″) | 13″ | A5Y/A4T/8.25″ | 0 | 1 | 0 | 1 | 1 | 0 | 1 | 0 | 0 | 1 | 0 | 1 | 0 | 1 | 1 |
| 6 | F4(8.5″x13″) | 13″ | 8.5″ | 0 | 1 | 0 | 1 | 1 | 1 | 0 | 0 | 1 | 0 | 1 | 1 | 0 | 1 | 1 |
| 7 | F(8″x13″) | 13″ | 8″ | 0 | 1 | 0 | 1 | 1 | 0 | 0 | 1 | 0 | 0 | 0 | 1 | 1 | 1 | 1 |
| 8 | LTT(8.5″x11″) | 11″ | 8.5″ | 0.5 | 1 | 0 | 0 | 0 | 1 | 0 | 0 | 1 | 0 | 1 | 1 | 0 | 1 | 0 |
| 9 | LTY | 8.5″ | 11″ | 0 | 1 | 1 | 0 | 0 | 0 | 1 | 1 | 0 | 0 | 0 | 1 | 1 | 0 | 0 |
| 10 | HLTT | 8.5″ | 5.5″ | 0 | 1 | 1 | 0 | 0 | 0 | 1 | 1 | 1 | 0 | 0 | 1 | 1 | 1 | 0 |
| 11 | HLTY | 5.5″ | 8.5″ | 0 | 1 | 1 | 0 | 0 | 1 | 0 | 0 | 1 | 0 | 1 | 1 | 1 | 1 | 0 |
| 12 | Exective(7.25″x10.5″)T | 16T/10.5″ | B5T(7.25″) | 0 | 0 | 0 | 0 | 0 | 1 | 0 | 1 | 0 | 0 | 1 | 0 | 1 | 0 | 0 |
| 13 | Exective(7.25″x10.5″)Y | B5Y(7.25″) | 16KY/8KT/10.5″ | 0 | 0 | 0 | 1 | 1 | 0 | 0 | 1 | 1 | 0 | 0 | 0 | 1 | 1 | 1 |
| 14 | A3 | A3T | A3T/A4Y | 1 | 1 | 0 | 0 | 1 | 1 | 0 | 0 | 0 | 0 | 1 | 1 | 0 | 0 | 1 |
| 15 | B4 | B4T | B5Y/B4T | 1 | 0 | 0 | 1 | 1 | 0 | 0 | 0 | 1 | 1 | 1 | 0 | 0 | 1 | 1 |
| 16 | A4T | A4T | A5Y/A4T/8.25″ | 0 | 1 | 0 | 0 | 1 | 0 | 1 | 0 | 0 | 1 | 0 | 1 | 0 | 0 | 1 |
| 17 | B5T | B5T | B5T(7.25″) | 0 | 0 | 0 | 0 | 1 | 1 | 0 | 1 | 0 | 0 | 1 | 0 | 1 | 0 | 1 |
| 18 | A4Y | A4Y/A5T | A3T/A4Y | 0.5 | 1 | 0 | 0 | 0 | 1 | 0.5 | 0 | 0 | 0 | 1 | 1 | 0 | 0 | 0 |
| 19 | A5T | A4Y/A5T | A5Y/A4T/8.25″ | 0.5 | 1 | 0 | 0 | 0 | 1 | 1 | 1 | 0 | 1 | 1 | 1 | 1 | 0 | 1 |
| 20 | B5Y | B5Y(7.25″) | B5Y/B4T | 0 | 0 | 0 | 1 | 1 | 0 | 0 | 0 | 1 | 1 | 0 | 0 | 0 | 1 | 1 |
| 21 | A5Y | A5Y | A5Y/A4T/8.25″ | 0 | 1 | 1 | 0 | 0 | 0 | 1 | 0 | 0 | 1 | 0 | 1 | 1 | 0 | 1 |
| 22 | 8KT | 8KT | 16KY/8KT/10.5″ | 0 | 0 | 1 | 1 | 0 | 0 | 0 | 1 | 1 | 0 | 0 | 0 | 1 | 1 | 0 |
| 23 | 16KT | 16KT/10.5″ | 16KT | 0 | 0 | 0 | 0 | 0 | 1 | 0 | 0 | 1 | 0 | 1 | 0 | 0 | 1 | 0 |
| 24 | 16KT | 16KY | 16KY/8KT/10.5″ | 1 | 0 | 0 | 0 | 1 | 0 | 0 | 1 | 1 | 0 | 1 | 0 | 1 | 1 | 1 |

PAPER FEED TRAY, PAPER FEEDING APPARATUS, AND IMAGE FORMING APPARATUS USING MOVABLE MEMBERS TO MOVE ALIGNING UNITS AND LOCK IN PLACE

CROSS-REFERENCE TO RELATED APPLICATIONS

The present document incorporates by reference the entire contents of Japanese priority document, 2004-331145 filed in Japan on Nov. 15, 2004.

BACKGROUND OF THE INVENTION

1. Field of the Invention

The present invention relates to a mechanism for detecting the size of a paper sheet stored in a paper feed tray of an image forming apparatus.

2. Description of the Related Art

An image forming apparatus generally includes box shaped paper feeding trays for storing or stacking paper sheets of various sizes. A paper feeder picks up an appropriate paper sheet and feed the paper sheet to relevant parts of the image forming apparatus.

In conventional image forming apparatuses, a user indicated the size of paper sheets loaded in the feeding tray with a manual operation. However, if the user makes an error, the error cannot be confirmed by the image forming apparatus, it results in a paper jam. Japanese Patent Laid-Open Publication No H11-165881 and Japanese Patent Laid-Open Publication No 2002-187626 disclose paper feeders that can automatically detect the paper size. However, these paper feeders can detect the paper size only in the paper feed direction, but not in the paper width direction. Although some paper feeders detect the paper size both in the paper feed direction as well as in the paper width direction, commonly used paper feeders can only approximately detect the paper size. This results in limitations on the detected paper sizes and a need to provide a plurality of paper size detecting sensors, thus increasing the cost.

The image forming apparatus is generally provided with a paper separating member that separates the top sheet from the other sheets in the paper feeding tray before feeding the top sheet. The paper separating member includes a feed roller that is stopped from rotation immediately when there is a failure in identification of the paper size or an error in setting of the paper size. This results in an increase in slipping of paper sheets, thereby lowering the accuracy of paper sheet transfer, and affecting productivity.

To overcome the aforementioned drawbacks, an automatic paper size detecting tray has been developed. Such a paper size detecting tray includes a lever that detects the paper size. The lever engages with a regulating member that regulates the paper in a paper width direction. For the sake of convenience for the user, the regulating member and a lock are preferably positioned at the front side of the paper size detecting tray. However, a paper size detecting switch to be pressed by the lever is positioned at the back side of the paper size detecting tray. Therefore, the lever is inevitably engaged with the regulating member at the back side. When the lever is engaged with the regulating member at the front side, shaking of a rack and a pinion and precision accumulation from other units are caused. This causes a shift in the position of the regulating member engaged with the lever, which leads to inaccurate paper size detection.

SUMMARY OF THE INVENTION

It is an object of the present invention to at least solve the problems in the conventional technology.

According to an aspect of the present invention, a detector for detecting a size of a recording medium in a device includes a tray that stores the recording medium to be fed to the device, the tray being detachably attached to the device, including a first regulating member capable of sliding in a width direction of the recording medium according to the size, and a second regulating member capable of sliding in a feed direction of the recording medium according to the size, a first movable member that engages with the first regulating member, rotates around a pivot in conjunction with the first regulating member, and includes a plurality of first convex members on a peripheral edge thereof, a second movable member, overlapped by the first movable member, that engages with the second regulating member, rotates around the pivot in conjunction with the second regulating member, and includes a plurality of second convex members on a peripheral edge thereof equidistant from the pivot with the first convex members, and a plurality of switches that are selectively pressed by a combination of the first convex members and the second convex members when the tray is attached to the device.

According to another aspect of the present invention, an image forming apparatus includes a detector for detecting a size of a recording medium in a device, including a tray that stores the recording medium to be fed to the device, the tray being detachably attached to the device, including a first regulating member capable of sliding in a width direction of the recording medium according to the size, and a second regulating member capable of sliding in a feed direction of the recording medium according to the size, a first movable member that engages with the first regulating member, rotates around a pivot in conjunction with the first regulating member, and includes a plurality of first convex members on a peripheral edge thereof, a second movable member, overlapped by the first movable member, that engages with the second regulating member, rotates around the pivot in conjunction with the second regulating member, and includes a plurality of second convex members on a peripheral edge thereof equidistant from the pivot with the first convex members, and a plurality of switches that are selectively pressed by a combination of the first convex members and the second convex members when the tray is attached to the device.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 12 depicts a table of pattern combinations of peripheral convex members of the first lever and the second lever;

DETAILED DESCRIPTION OF THE PREFERRED EMBODIMENTS

Exemplary embodiments of the present invention are explained next with reference to the accompanying drawings.

Figure 1:
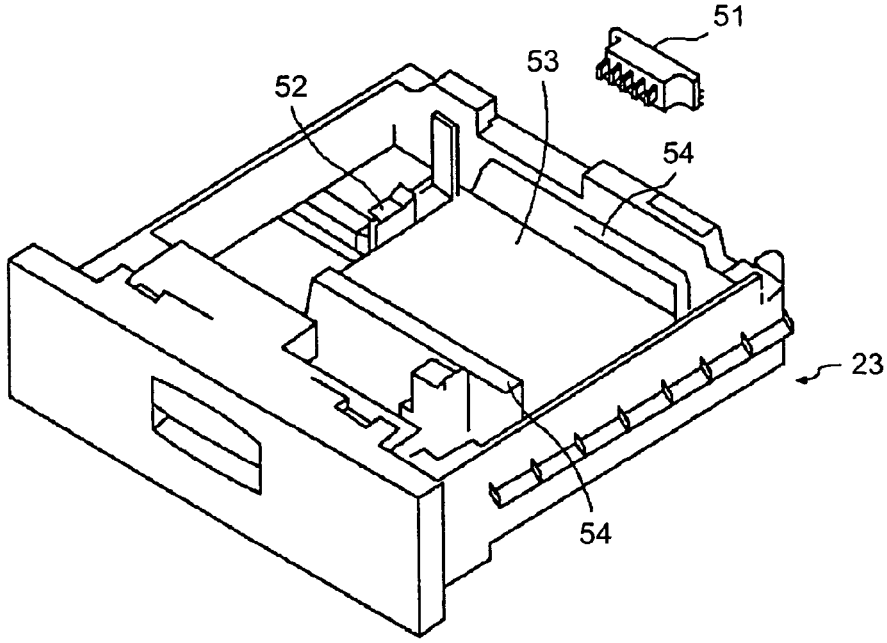
FIG. 1 is a perspective view of a paper feed tray and a paper size detector according to an embodiment of the present invention.

FIG. 1 is a perspective view of a box shaped paper feed tray 23 and a paper size detecting sensor 51 according to an embodiment of the present invention. Paper sheets 53 are loaded in the paper feed tray 23 after opening the upper surface. The loaded paper sheets 53 are regulated by means of movable side fences 54 and a movable end fence 52.

Figure 2:
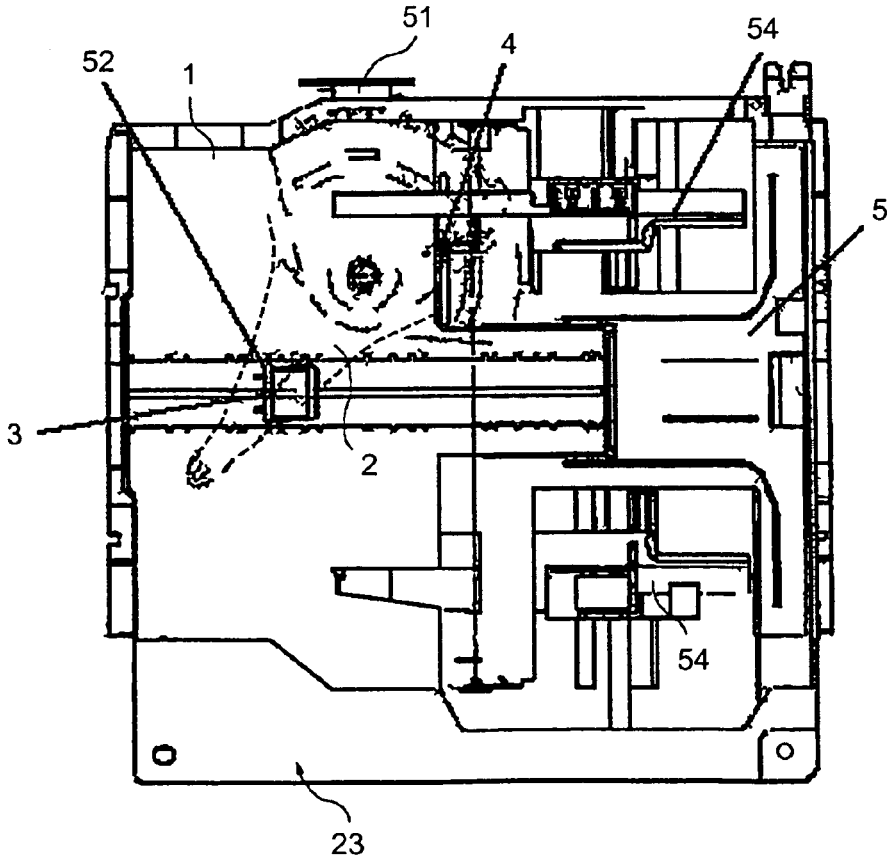
FIG. 2 is a drawing of a structure of a paper size detecting mechanism according to the embodiment.
Figure 3:
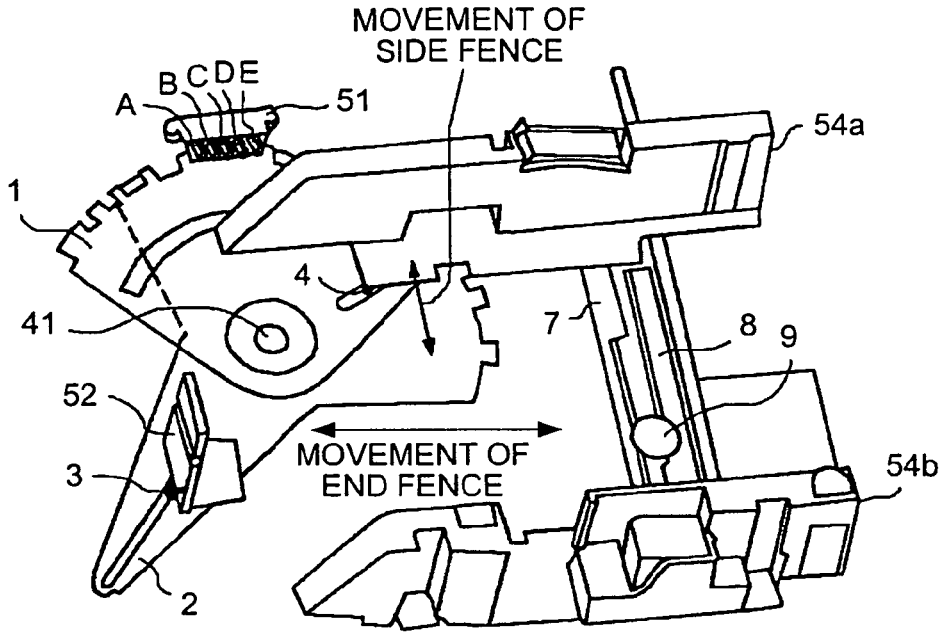
FIG. 3 is a perspective view of the paper feed tray shown in FIG. 1 without a chassis.

FIG. 2 is a drawing of a structure of a paper size detecting mechanism that engages with the end fence 52 and one of the side fences 54 of the paper feed tray 23. FIG. 3 is a drawing of the paper feed tray 23 without a chassis. The paper feed tray 23 is provided with a floor plate 5 that elevates the loaded paper sheets to facilitate paper transfer. The loaded paper sheets are regulated by means of the side fence 54 that can slide in the paper width direction along a slit provided at the bottom of the paper feed tray 23. Similarly, the loaded paper sheets are also regulated in the paper feed direction by means of the end fence 52 that can slide in the paper feed direction along another slit provided at the bottom of the paper feed tray 23. An engaging spindle 3 of the end fence 52 positioned on the back side of the paper feed tray 23 extends via a slit provided in the paper feed tray 23 to another slit provided in the core of a second lever 2. By sliding the end fence 52 in the paper feed direction, the engaging spindle 3 of the end fence 52 moves along the slit provided in the second lever 2, and the second lever 2 turns along a turning pivot 41 shown in FIG. 3 and FIG. 4. As shown in FIG. 3 and FIG. 5, the side fence 54 is moved in the paper width direction along racks 7, 8, and a pinion gear 9. An engaging spindle 4 provided on a posterior side fence 54*a* (shown in FIG. 3) extends via a slit in the paper width direction provided on the paper feed tray 23 to a slit provided on a first lever 1. By sliding the posterior side fence 54*a*, the engaging spindle 4 moves along the slit provided in the first lever 1, and the first lever 1 turns along the turning pivot 41.

Figure 4:
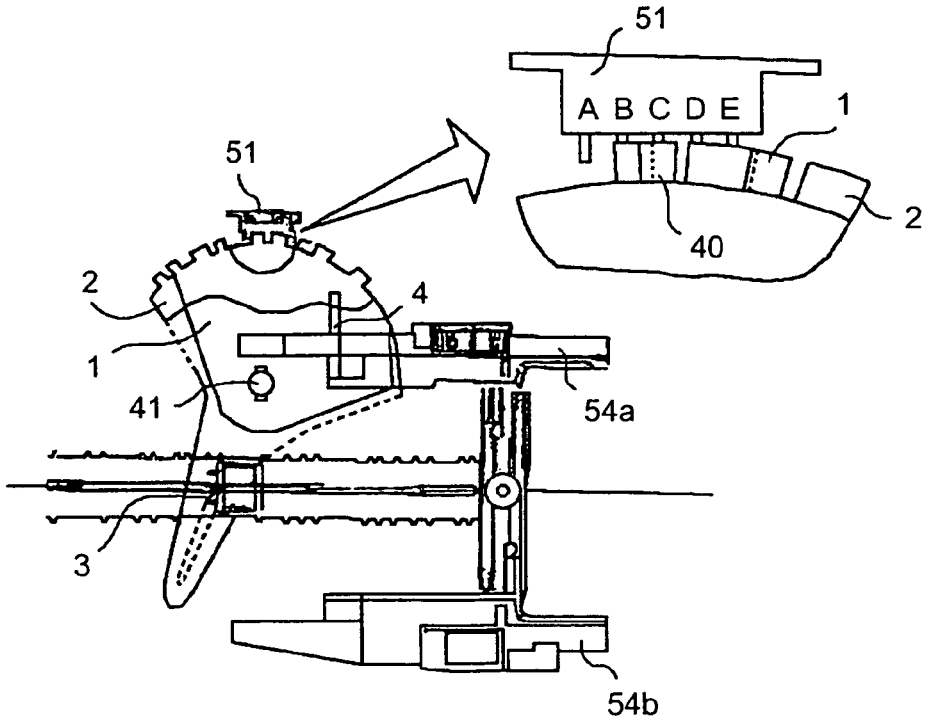
FIG. 4 depicts a pressing operation of switches of a paper size detecting sensor shown in FIGS. 1 and 2.
Figure 5:
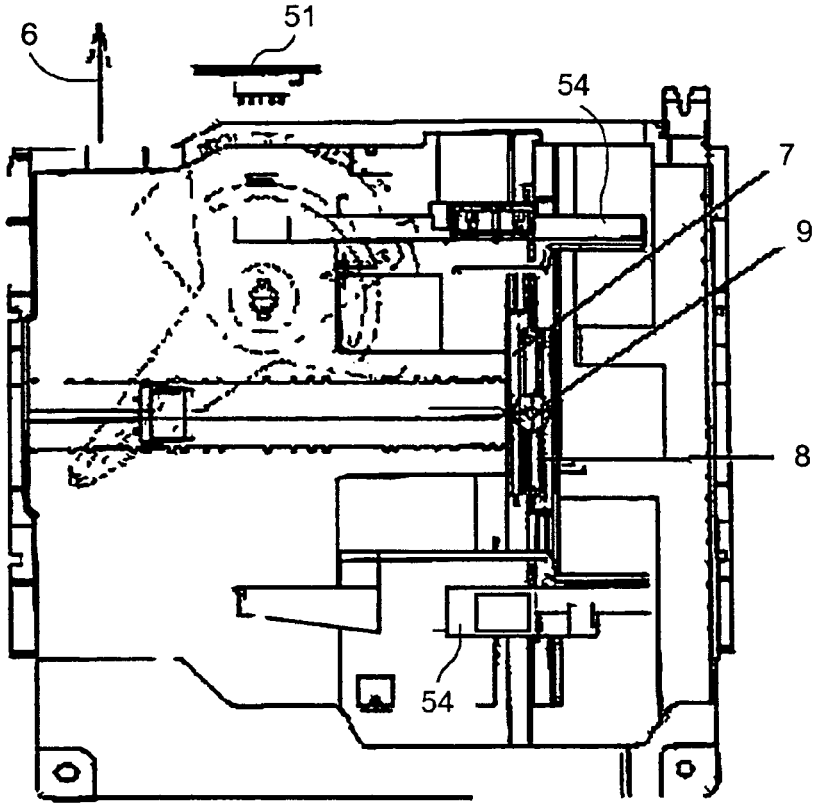
FIG. 5 is a drawing of the paper feed tray before attachment to an image forming apparatus.

As shown in FIG. 2 through FIG. 4, the paper size detecting sensor 51 is pressed by convex members on the peripheral edge of both the first lever 1 and the second lever 2. As shown in FIG. 3, push switches A through E of the paper size detecting sensor 51 can be selectively pressed to output respective ON signals. As shown in FIG. 5, an arrow 6 indicates a setting direction of the paper feed tray 23. Thus, one of the side fences 54 is on the anterior side, and the other is on the posterior side. When the paper feed tray 23 is set, the paper size detecting sensor 51 provided on the image forming apparatus is pressed against by convex members on the peripheral edge of the first lever 1 and the second lever 2.

Figure 6:
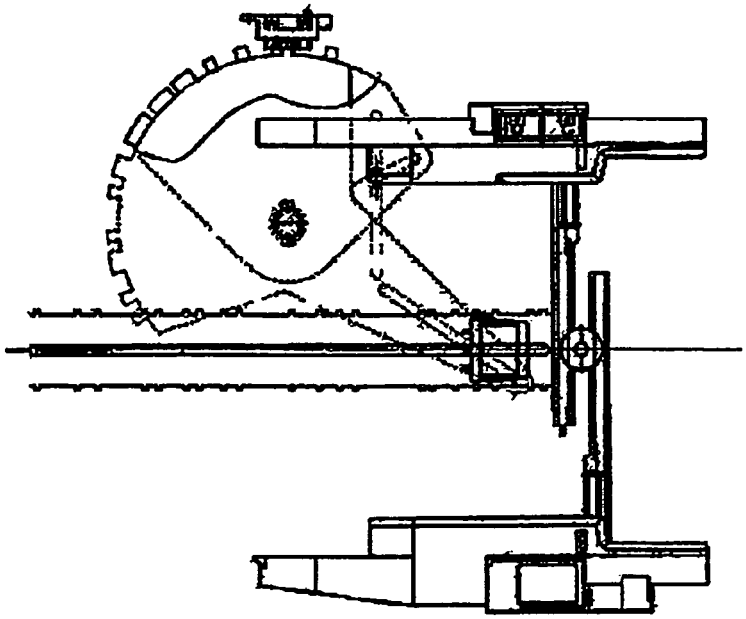
FIG. 6 is a drawing of a change in position, as compared to FIG. 4, of peripheral convex members of a first lever shown in FIG. 3.
Figure 7:
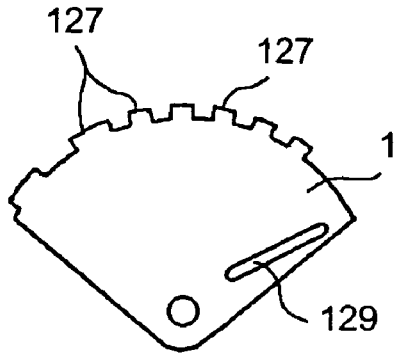
FIG. 7 is a drawing of a shape of the first lever.
Figure 8:
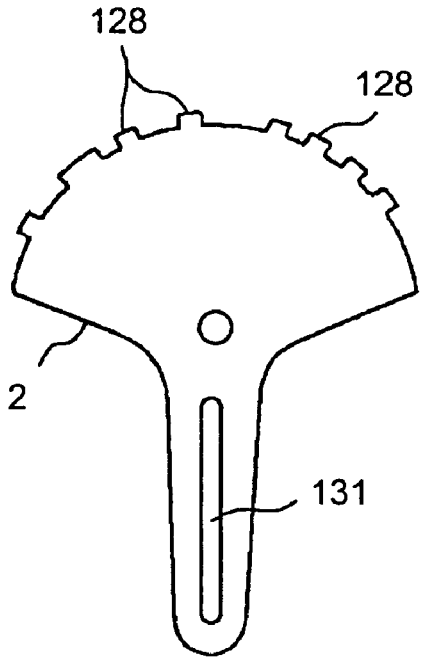
FIG. 8 is a drawing of a shape of a second lever shown in FIG. 3.

FIG. 4 and FIG. 6 are drawings of a change in the convex members that press the push switches of the paper size detecting sensor 51 based on a movement of the first lever 1 and the second lever 2 due to movement of the side fence 54 and the end fence 52. The change in the convex members is explained in detail with reference to FIG. 7 through FIG. 9. FIG. 7 is a drawing of the first lever 1 that is fan shaped. FIG. 8 is a drawing of the second lever 2 that is similar in shape to a ginkgo biloba leaf. The first lever 1 and the second lever 2 are positioned to overlap each other and are fixed to turn around the centerline of the common turning pivot 41. Both the first lever 1 and the second lever 2 are formed of a single plate shaped member. Both the first lever 1 and the second lever 2 include an arc shaped periphery that is equidistant from the center of the turning pivot 41. A plurality of first convex members 127 are formed on the arc shaped periphery of the first lever 1 and a plurality of second convex members 128 are formed on the arc shaped periphery of the second lever 2. A first slide groove 129 is provided on the first lever 1 along a direction that intersects the slit of the paper feed tray 23. In other words, the first slide groove 129 extends in a direction that intersects with the sliding direction of the side fence 54. The engaging spindle 4 of the side fence 54 is slidably connected to the first slide groove 129. Due to this, when the side fence 54 is made to slide in a direction perpendicular to the paper feed direction, the engaging spindle 4 slides in the slit and the first slide groove 129, and the first lever 1 turns around the centerline of the turning pivot 41. A second slide groove 131 is provided on the second lever 2 along a direction that intersects the other slit on the paper feed tray 23. In other words, the second slide groove 131 extends in a direction that intersects with the sliding direction of the end fence 52. The engaging spindle 3 of the end fence 52 is slidably connected to the second slide groove 131. Due to this, when the end fence 52 is made to slide in the paper feed direction, the engaging spindle 3 slides in the slit and the second slide groove 131, and the second lever 2 turns around the centerline of the turning pivot 41.

Figure 9:
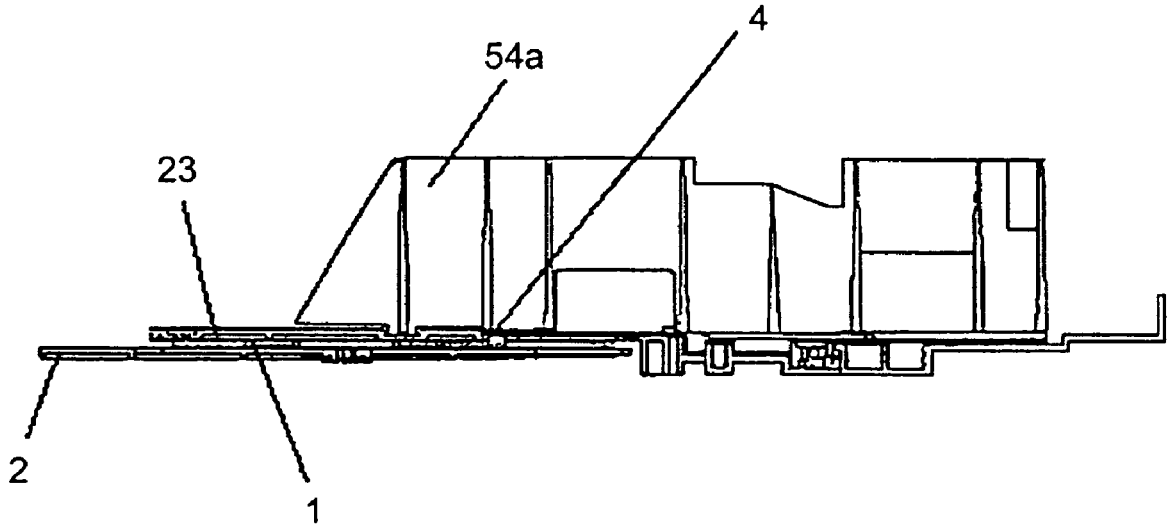
FIG. 9 is a cross sectional view of the paper feed tray in the paper feed direction.
Figure 10:
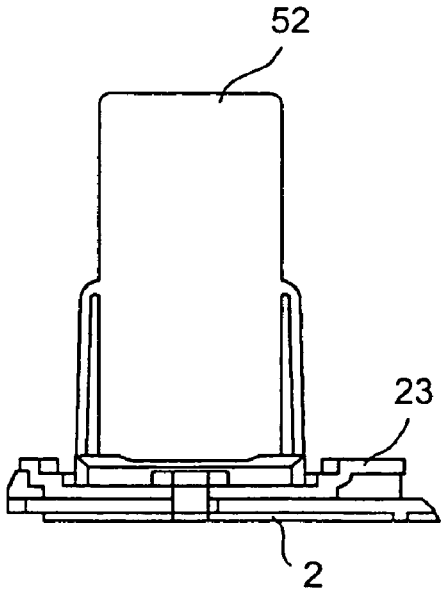
FIG. 10 is a cross sectional view of the paper feed tray in the paper width direction.

Because the first lever 1 and the second lever 2 are positioned to overlap each other, the first convex members 127 of the first lever 1 and the second convex members 128 of the second lever 2 are also positioned to overlap each other. Combined convex members 133 are formed due to overlapping of the first convex members 127 and the second convex members 128. The combined convex members 133 form a pattern to press the push switches of the paper size detecting sensor 51. An overlapping state of the first lever 1 and the second lever 2 is shown in FIG. 9. FIG. 9 is a cross sectional view of the paper feed tray 23 in the paper feed direction. The engaging spindle 4 of the side fence 54 engages with the first lever 1, and the second lever 2 is overlapped by the first lever 1. FIG. 10 is a cross sectional view of the paper feed tray 23 in the paper width direction. Engagement of the second lever 2 with the engaging spindle 3 of the end fence 52 is shown.

An overlapped state of the first convex members 127 and the second convex members 128 changes according to the turning of the first lever 1 and the second lever 2 around the centerline of the turning pivot 41, thereby changing the dimension and the position of the combined convex members 133 along the direction of the array of push switches that are provided on the paper size detecting sensor 51. In other words, the dimension and the position of the combined convex members 133 change according to the size of the paper sheets that are loaded in the paper feed tray 23. The paper size detecting sensor 51 is provided inside the image forming apparatus along the edge in the setting direction 6 of the paper feed tray 23, and includes push switches 51A through 51E that are selectively pressed by the combined convex members 133.

Figure 11A:
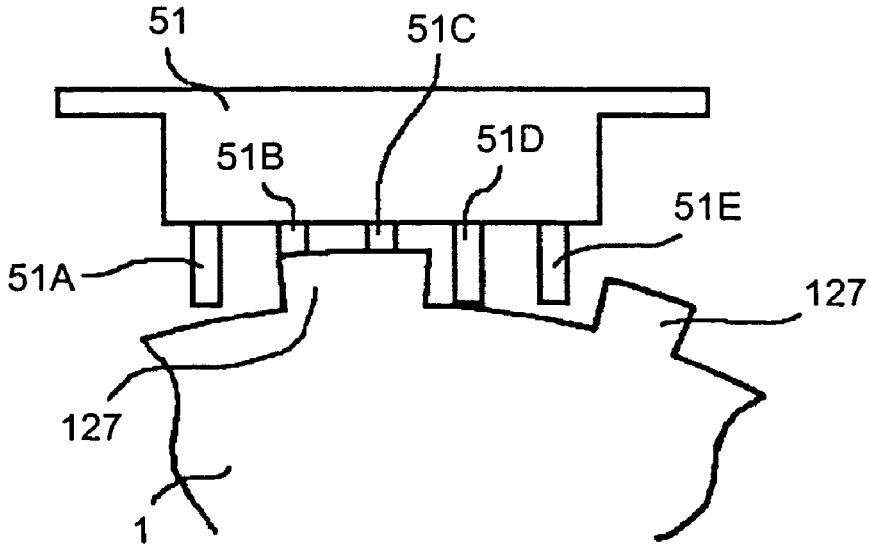
FIG. 11A through FIG. 11F depict pressed conditions of the push switches of the paper size detecting sensor.
Figure 11B:
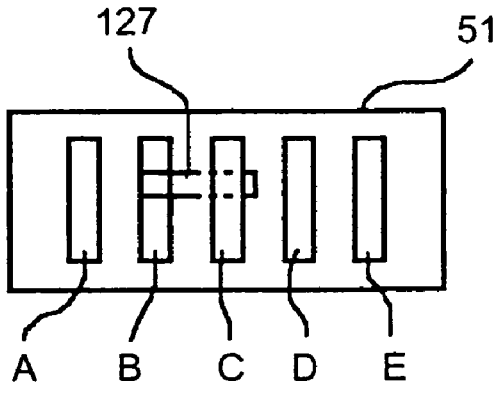
Figure 11C:
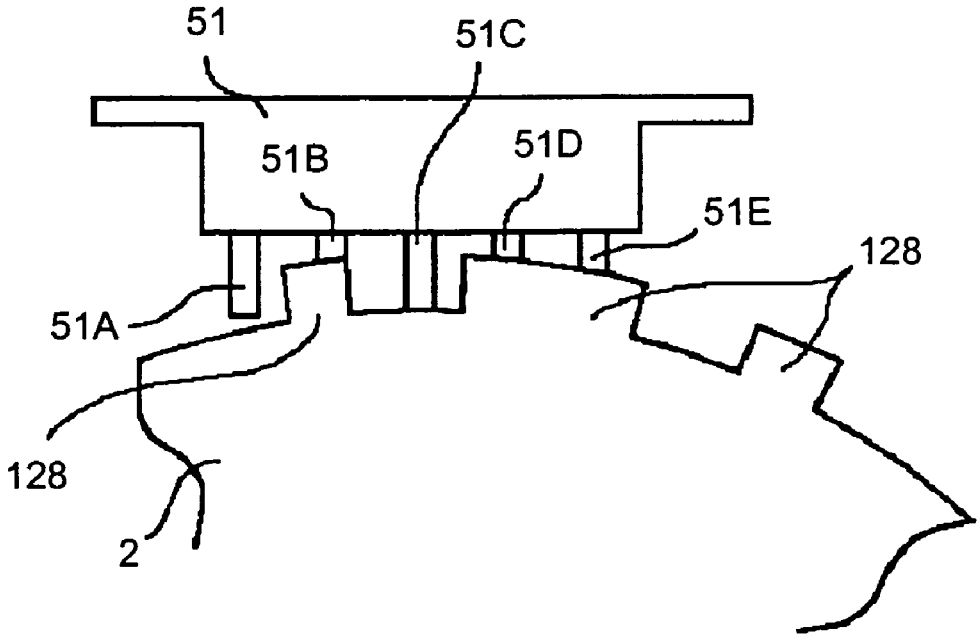
Figure 11D:
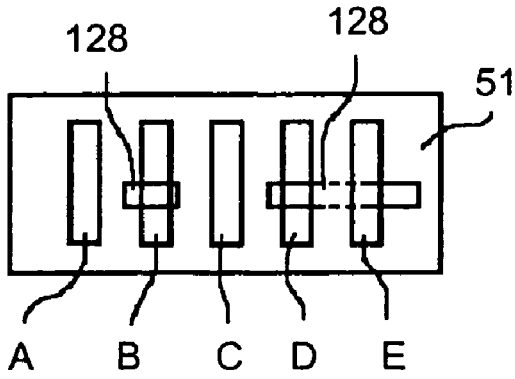
Figure 11E:
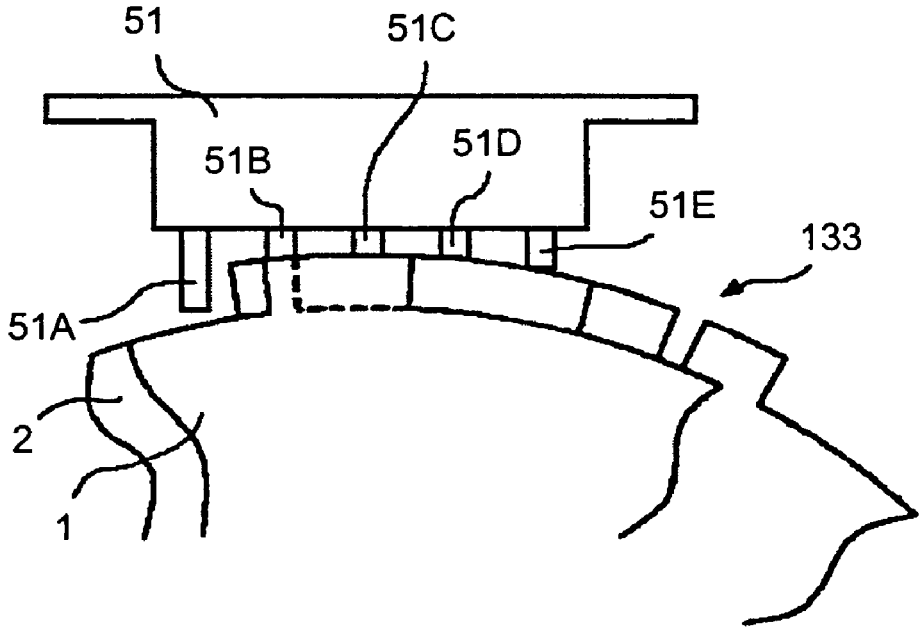
Figure 11F:
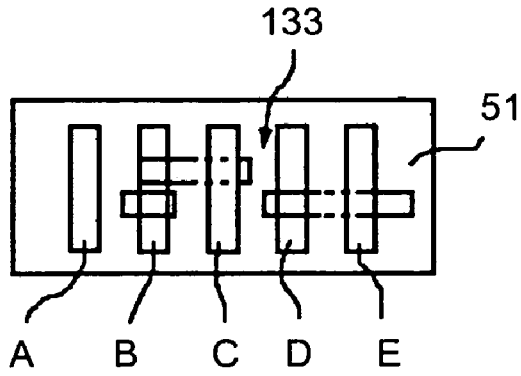

FIG. 11A through FIG. 11F are drawings of pressed condition of the push switches 51A through 51E by means of the first convex members 127, the second convex members 128, and the combined convex members 133 when the paper feed tray 23 loaded with paper sheets of predetermined sizes is set in the image forming apparatus. FIG. 11A and FIG. 11B are drawings of a positional relation between the push switches 51A through 51E and the first convex members 127. The push switches 51B and 51C opposite the first convex members 127 are pressed by the first convex members 127 and are turned ON. FIG. 11C and FIG. 11D are drawings of a positional relation between the push switches 51A through 51E and the second convex members 128. The push switches 51B, 51D, and 51E opposite the second convex members 128 are pressed by the second convex members 128 and are turned ON. FIG. 11E and FIG. 11F are drawings of a positional relation between the push switches 51A through 51E and the combined convex members 133. The push switches 51B, 51C, 51D, and 51E opposite the combined convex members 133 are pressed by the combined convex members 133 and are turned ON. Pattern combinations of the aforementioned convex members are shown in a table in FIG. 12. Entries A through E in the table indicate each of the push switches 51A through 51E respectively of the paper size detecting sensor 51 that is shown in FIG. 3 and FIG. 4. A switch that is turned OFF (switch not pressed: concave pattern) is indicated by "0", and a switch that is turned ON (switch pressed: convex pattern) is indicated by "1". A switch that is not pressed completely (an operation error) is indicated by "0.5".

It is not easy to make the shape of the convex members to match with the spacing between the push switches 51A through 51E of the paper size detecting sensor 51. There are cases where the edge of the convex members of the second lever 2 barely touch the push switch 51C, as indicated by 40 in FIG. 4. However, during large scale production of images, it is not guaranteed that the convex members of the second lever 2 do not touch the push switch 51C due to such minute spacing. The aforementioned drawback is overcome by using the convex members of the first lever 1 to press the push switch 51C. Thus, the convex members of the first lever 1 and the second lever 2 are designed to complement each other. When the image forming apparatus needs to be compact, it is not possible to increase in the spacing between the push switches 51A through 51E or to increase in the dimensions of the first convex members 127 and the second convex members 128. Therefore, the push switches 51A through 51E cannot always be pressed properly by using only one of the first convex members 127 or the second convex members 128. Upon observation, a proper pressing operation of the push switch 51C can be ensured by using the combined convex members 133, but not by using only the second convex members 128. In other words, the first convex members 127 complement the second convex members 128 to ensure that the push switch 51C is pressed.

Figure 13:
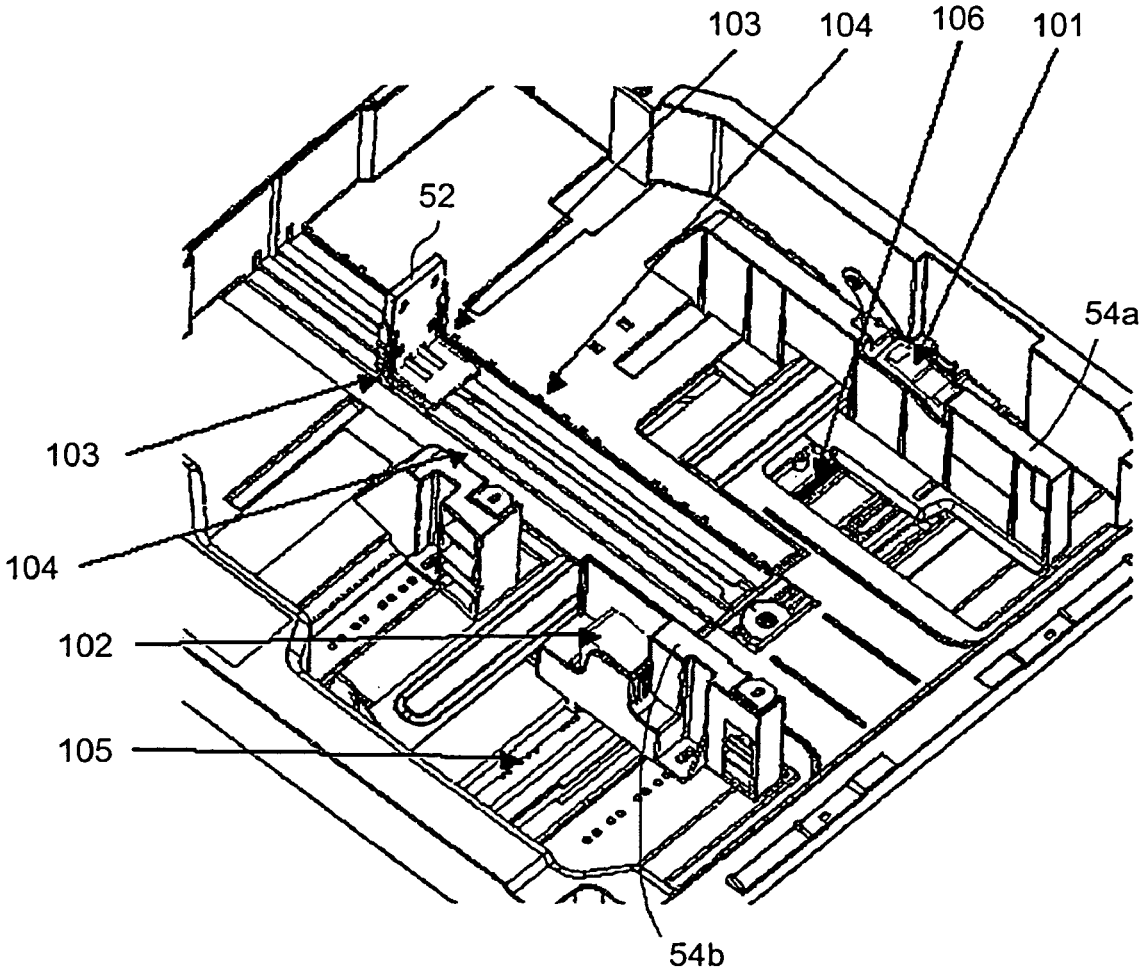
FIG. 13 depicts lock mechanisms of the end fence and the side fence shown in FIG. 1.
Figure 14:
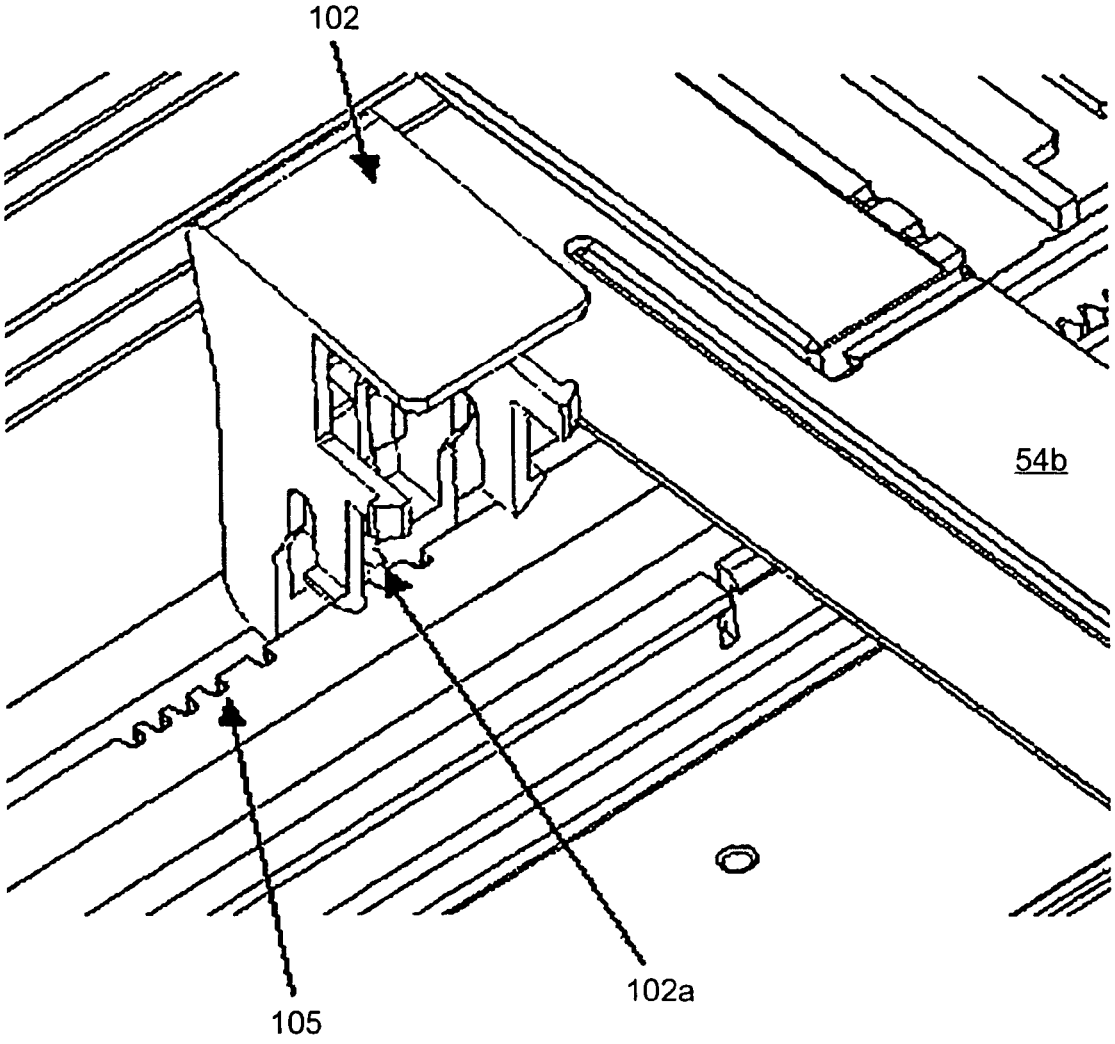
FIG. 14 is a detailed drawing of the lock mechanism of an anterior side fence shown in FIG. 13.

FIG. 13 is a drawing of lock mechanisms of the end fence 52 and the side fence 54. A flexible arm 103 provided on the end fence 52 includes convex members that engage with concave members 104 provided on the paper feed tray 23 corresponding to standard paper sizes to lock the end fence 52. As shown in FIG. 14 (FIG. 13 partially enlarged), convex members 102*a* provided on a lock lever 102 engage with concave members 105 corresponding to standard paper sizes to lock an anterior side fence 54*b*.

Figure 15:
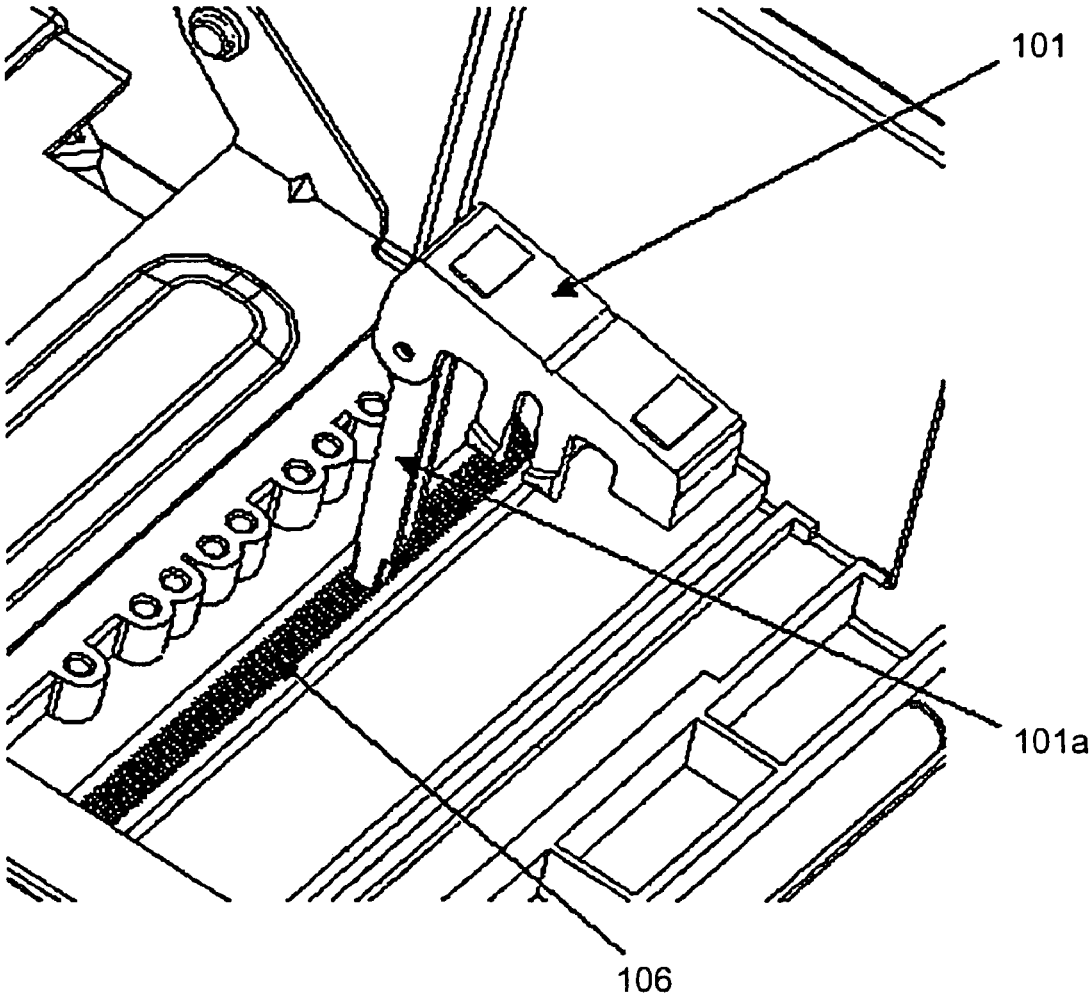
FIG. 15 is a detailed drawing of the lock mechanism of a posterior side fence shown in FIG. 13.

As shown in FIG. 15, a latch provided on the edge of a stopper 101*a* that is attached to a lock lever 101 engages with a corresponding latch 106 provided on the paper feed tray 23 to lock the posterior side fence 54*a* that engages with the first lever 1 to detect a paper size. The aforementioned latch mechanism enables locking of the posterior side fence 54*a* according to irregular paper sizes.

Figure 16:
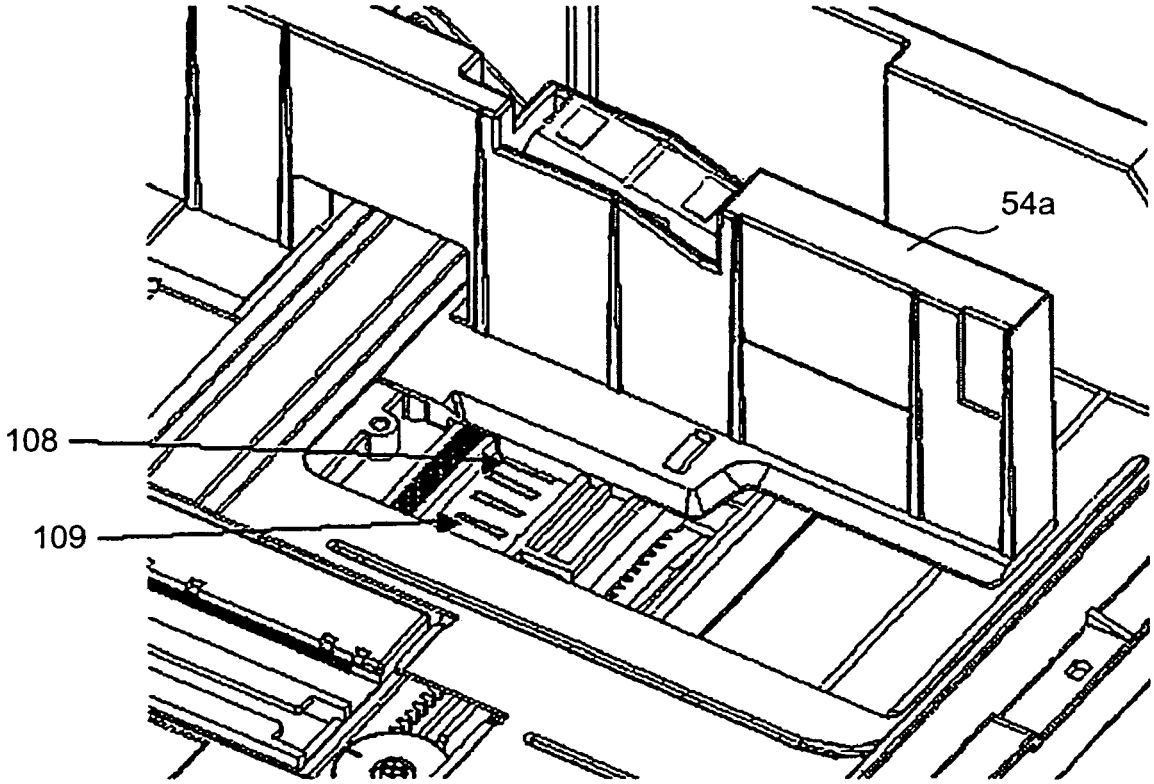
FIG. 16 depicts a structure that determines positions of the posterior side fence according to standard paper sizes.
Figure 17:
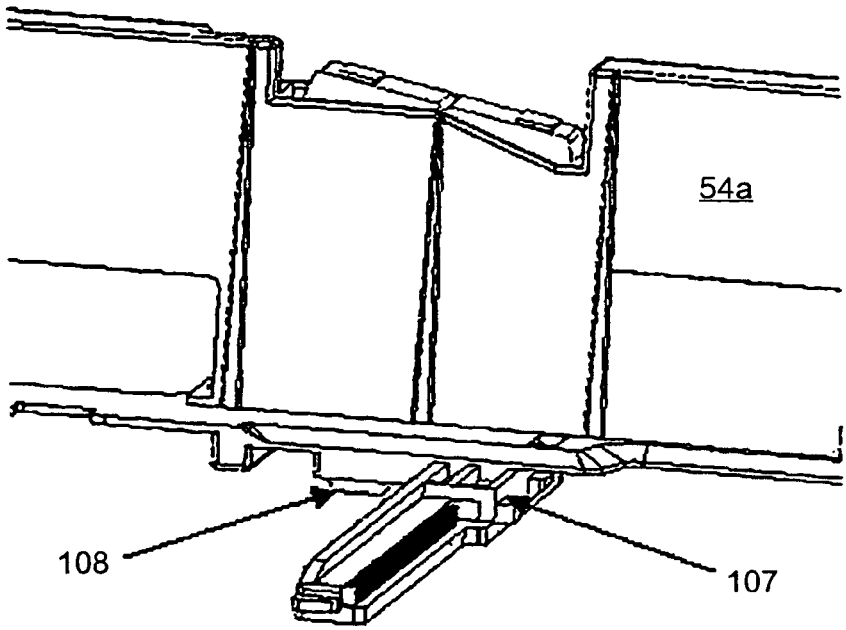
FIG. 17 is a drawing of a pawl that prevents slipping of the posterior side fence from the paper feed tray.

To enhance accuracy of rotating position of the first lever 1, shaking of rack and pinion of the side fence 54 and precision accumulation from units that are positioned with the aid of the anterior side fence 54*b* need to be prevented. As shown in FIG. 16, a convex member 108 provided on the posterior side fence 54*a* engages with a groove 109 provided on the paper feed tray 23, thereby enabling to determine specific positions of the posterior side fence 54*a* for standard paper sizes. As shown in FIG. 17, a pawl 107 prevents slipping of the paper feed tray 23 in the upward direction and strengthens engagement.

Figure 18:
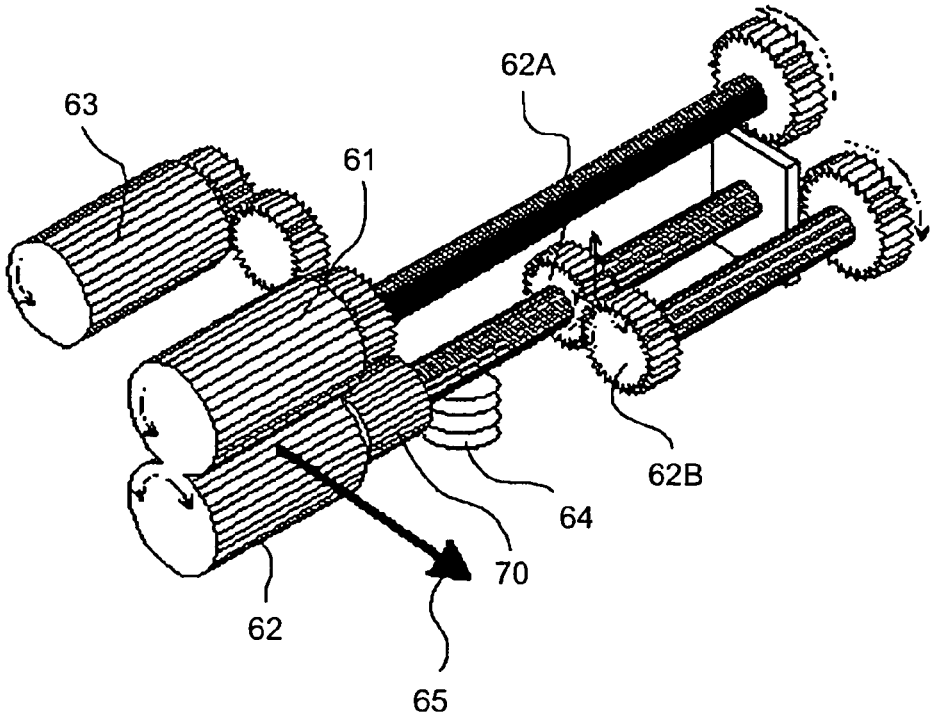
FIG. 18 is perspective view of a False Rejection Rate (FRR) separating device used as a paper feeder.

In the present embodiment, a False Rejection Rate (FRR) separating device is used as a paper feeder, which is positioned between a feed roller and a separating member that is pressed against the feed roller. The paper feeder separates and transfers paper sheets. The FRR separating device is explained next. As shown in FIG. 18, a pickup roller 63 transfers the uppermost paper sheet from not shown loaded paper sheets to a feed roller 61. A torque remitter 70 and a reverse roller 62 apply predetermined torque to the feed roller 61, which rotates in a paper feed direction 65, in a direction opposite to the paper feed direction 65. A driven gear 62A provided on the spindle of the reverse roller 62 engages with a drive gear 62B to apply the torque that is created due to tooth surface pressure and activation welding force between the drive gear 62B and the driven gear 62A. By driving the reverse roller 62 pressed against the feed roller 61 by means of an elastic member 64 (a spring in the present embodiment), the paper sheets are separated and transferred one by one. When using the aforementioned separating mechanism, handling the separation of paper sheets by means of the reverse roller 62 until the paper sheet is disengaged from the feed roller 61 and the reverse roller 62 enables to prevent continuous feeding or feeding of multiple paper sheets resulting from sticking of the paper sheets. However, if the reverse roller 62 is driven when the feed roller 61 is stopped, force is applied in a direction opposite to the paper feed direction 65 due to torque remitter load, thereby resulting in increased slipping of the paper sheets. Although the feed roller 61 needs to be driven to prevent slipping of the paper sheets, the feed roller 61 is stopped before a paper sheet is disengaged from the feed roller 61 to prevent transfer of the subsequent paper sheet to the image forming apparatus. Stopping the feed roller 61 at the appropriate point of time enables to maximize the driving time of the feed roller 61, thereby minimizing paper slipping. Thus, an accurate knowledge of the paper size can enable a high precision paper transfer.

Figure 19:
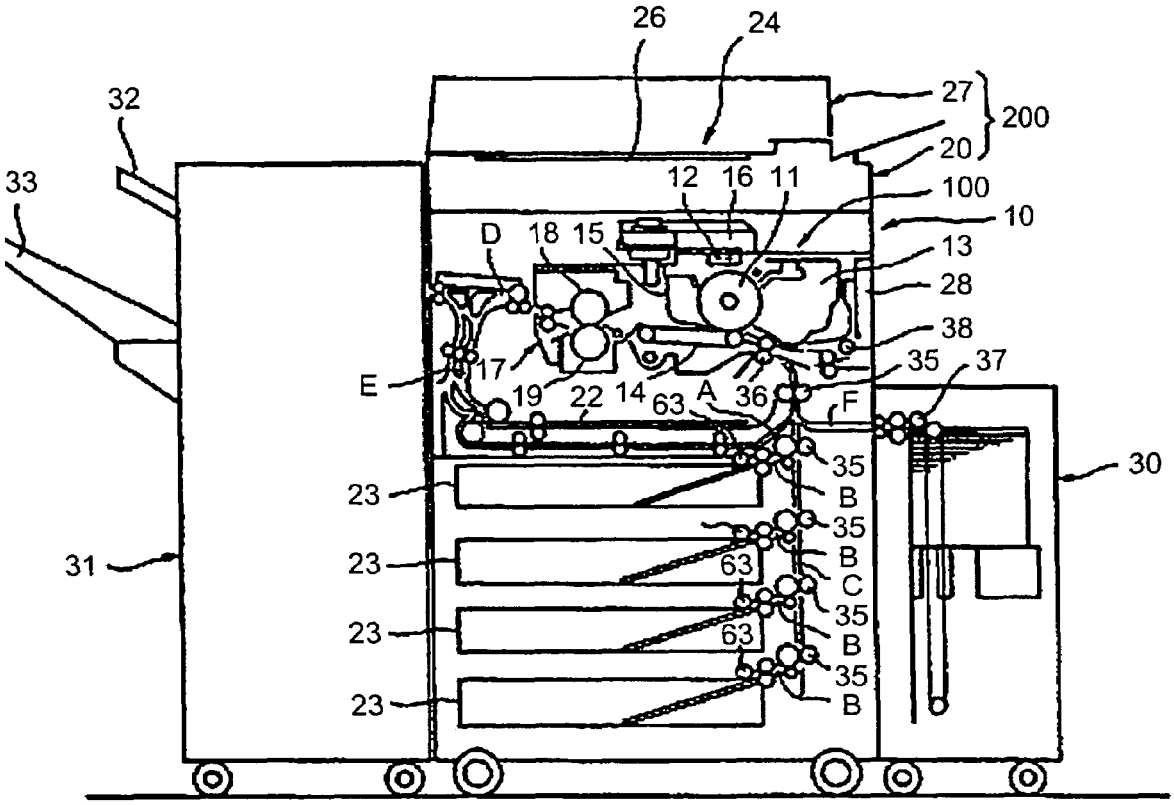
FIG. 19 is a drawing of an image forming apparatus.

FIG. 19 is a drawing of the image forming apparatus that is provided with the paper feed tray according to the embodiment. An image forming unit 100 is provided inside an image forming apparatus 10. The image forming unit 100 is provided with an image carrier 11 in the form of a drum (photosensitive drum). A charging unit 12, a developing unit 13, a printing and transfer unit 14, and a cleaning unit 15 are positioned around the image carrier 11. A laser writer 16 is provided above the image forming unit 100. The laser writer 16 is provided with a not shown light source such as a laser diode, a rotating polygonal mirror for scanning, a polygon motor, a scanning optical system such as a mirror etc. A fixing unit 17 is provided to the left of the cleaning unit 15. The fixing unit 17 is provided with a fixing roller 18 having an inbuilt heater, and a pressure roller 19 that is pressed against the fixing roller 18 from below.

A bifacial unit 22 and four paper feed trays 23 are provided one above the other inside lower part of the image forming apparatus 10. Sheets such as paper sheets, Over Head Projector (OHP) transparencies etc. are stored in the paper feed trays 23. A paper refeed path A from the bifacial unit 22 and a supply path B from the paper feed trays 23 lead to a common paper feed path C that extends to the lower side of the image carrier 11 (towards the upper end of paper transfer). The bifacial unit 22 is provided with a reverse path E that is formed by branching of a paper eject path D that extends from outlet port of the fixing unit 17.

A contact glass 26 is provided in an image reader 24 of the image forming apparatus 10. The contact glass 26 is covered with an automatic document transfer unit 27 that is provided above the image forming apparatus 10. The automatic document transfer unit 27 can open and close by itself. The automatic document transfer unit 27 and an optical reader 20 form an image reader 200.

A manual paper feed tray 28 which can open and close by itself is provided on the right surface of the image forming apparatus 10. The manual paper feed tray 28 directs manually input paper sheets to the paper feed path C. The image forming apparatus 10 is also externally provided with a large scale paper feeder 30. A large number of paper sheets are movably loaded and stored in the large scale paper feeder 30. A sheet post processor 31 is externally provided on the left surface of the image forming apparatus 10. The sheet post processor 31 collects the paper sheets that are ejected via the paper eject path D, and either directly ejects the paper sheets into an upper tray 32, or carries out a post process such as stapling, punching etc. and ejects the post processed paper sheets into the upper tray 32, or a lower tray 33.

When taking a copy with the image forming apparatus 10, a document is set in the automatic document transfer unit 27, or the document is directly set above the contact glass 26 after opening the automatic document transfer unit 27. Next, a not shown start switch is pressed to drive the automatic document transfer unit 27. The optical reader 20 reads the document that is transferred above the contact glass 26 of the image reader 24, or the document that is prior set above the contact glass 26. Simultaneously, the pick up roller 63 and the feed roller 61 are rotated accordingly to transfer a paper sheet from the cassettes inside the multiple paper feed trays 23 that are provided one above the other inside the image forming apparatus 10. The paper sheet is inserted into the paper feed path C via the supply path B, transferred by a transfer roller 35 and struck against a resist roller 36. The resist roller 36 is rotated in synchronization with rotations of the image carrier 11, and the transferred paper sheet is sent below the image carrier 11 of the image forming unit 100. To be specific, the paper sheet is sent out from the large scale paper feeder 30 by rotating a pick up roller 37, inserted into the paper feed path C via a transfer path F, transferred by the transfer roller 35 and struck against the resist roller 36. Or a paper feed roller 38 provided in a manual paper feeder is rotated and a paper sheet that is set on the opened manual paper feed tray 28 is inserted into the feeder path C, and similarly struck against the resist roller 36. Next, the resist roller 36 is rotated in synchronization with rotations of the image carrier 11, and the transferred paper sheet is sent below the image carrier 11 of the image forming unit 100.

Upon pressing the not shown start switch, the image carrier 11 of the image forming unit 100 rotates in a clockwise direction. Next, the charging unit 12 uniformly charges the surface of the rotating image carrier 11. The laser writer 16 carries out writing of data, by means of exposure to a laser beam, according to the data content of the document that is read by the optical reader 20 and forms an electrostatic latent image on the surface of the image carrier 11. The developing unit 13 converts the electrostatic latent image into a toner image by adding toner. The toner image is printed with the aid of the printing and transfer unit 14 on the paper sheet that is sent below the image carrier 11. After printing of the toner image, the cleaning unit 15 cleans the surface of the image carrier 11 by removing excess toner, thereby enabling the image carrier 11 to similarly carry out image formation for the next image data. The image carrier 11, the printing and transfer unit 14, and the cleaning unit 15, for example, form a process cartridge unit.

After printing of the toner image, the paper sheet is transferred by the printing and transfer unit 14, inserted into the fixing unit 17, the printed toner image is fixed by means of addition of heat and pressure by the fixing roller 18 and the pressure roller 19 respectively. Next, the paper sheet is ejected to the sheet post processor 31 via the paper eject path D. When forming image on both sides of the paper sheet, the paper sheet having fixed printed image on one side is inserted into the reverse path E midway from the paper eject path D, reversed and refed with the aid of the bifacial unit 22. A separately formed toner image on the image carrier 11 is printed on the reverse side of the paper sheet by the printing and transfer unit 14, the printed toner image is fixed by the fixing unit 17, and the paper sheet is ejected to the sheet post processor 31.

According to an aspect of the present invention, a paper sheet size can be detected accurately and reliably. Furthermore, an error in detection of a paper sheet size can be prevented. Moreover, a paper feed tray that accommodates any size of paper sheet can be provided.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A detector for detecting a size of a recording medium in a device, comprising:

a tray that stores the recording medium to be fed to the device, the tray being detachably attached to the device, including a first regulating member capable of sliding in a width direction of the recording medium according to the size of the recording medium, and a second regulating member capable of sliding in a feed direction of the recording medium according to the size of the recording medium;

a first movable member that engages with the first regulating member, rotates around a pivot in conjunction with the first regulating member, and includes a plurality of first convex members on a peripheral edge thereof;

a second movable member, overlapped by the first movable member, that engages with the second regulating member, rotates around the pivot in conjunction with the second regulating member, and includes a plurality of second convex members on a peripheral edge thereof, the first and second convex members are formed equidistant from the pivot, wherein the first convex members and the second convex members form a plurality of combined convex members; and a plurality of switches that are selectively pressed by the plurality of combined convex members when the tray is attached to the device.

2. The detector according to claim 1, wherein the first regulating member and the second regulating member are locked in a position corresponding to the size of the recording medium.

3. The detector according to claim 2, further comprising:

a first lock that locks the first regulating member; and a second lock that locks the second regulating member.

4. The detector according to claim 3, wherein at least one of the first lock and the second lock stops in the width and feed directions, respectively.

5. An image forming apparatus comprising:

a detector for detecting a size of a recording medium in a device, including a tray that stores the recording medium to be fed to the device, the tray being detachably attached to the device, including a first regulating member capable of sliding in a width direction of the recording medium according to the size of the recording medium, and a second regulating member capable of sliding in a feed direction of the recording medium according to the size of the recording medium, a first movable member that engages with the first regulating member, rotates around a pivot in conjunction with the first regulating member, and includes a plurality of first convex members on a peripheral edge thereof, a second movable member, overlapped by the first movable member, that engages with the second regulating member, rotates around the pivot in conjunction with the second regulating member, and includes a plurality of second convex members on a peripheral edge thereof equidistant from the pivot with the first convex members, wherein the first convex members and the second convex members form a plurality of combined convex members, and a plurality of switches that are selectively pressed by the plurality of combined convex members when the tray is attached to the device.

* * * * *